United States Patent [19]

Braun

[11] 4,072,038

[45] Feb. 7, 1978

[54] WIRE DRAWING MACHINES

[75] Inventor: Egon Braun, Haag near Schwabach, Germany

[73] Assignee: Maschinenfabrik Niehoff KG, Schwabach, Germany

[21] Appl. No.: 735,187

[22] Filed: Oct. 26, 1976

[30] Foreign Application Priority Data

Nov. 10, 1975 Germany ..... 2550373

[51] Int. Cl.[2] ..... B21C 1/02

[52] U.S. Cl. ..... 72/289

[58] Field of Search ..... 72/289, 278, 280; 74/190, 191

[56] References Cited

U.S. PATENT DOCUMENTS

| | | | |
|---|---|---|---|
| 824,655 | 6/1906 | Horton | 72/289 |
| 827,019 | 7/1906 | Horton | 72/289 |
| 1,653,097 | 12/1927 | Hodgson | 72/289 |
| 1,973,596 | 9/1934 | Yousey | 72/289 |
| 2,024,769 | 12/1935 | Johnson | 72/286 |
| 2,241,956 | 5/1941 | Nye | 72/289 |
| 2,880,623 | 4/1959 | Beier | 74/190 |
| 3,285,083 | 11/1966 | Singer | 74/191 |
| 3,646,834 | 3/1972 | Davis | 74/665 GA |
| 3,953,998 | 5/1976 | Braun | 72/289 |

FOREIGN PATENT DOCUMENTS

| | | | |
|---|---|---|---|
| 1,144,673 | 3/1963 | Germany | 72/289 |

*Primary Examiner*—Michael J. Keenan

[57] ABSTRACT

At least two adjacently located wire drawing capstans are provided with an annular drawing ring and a wheel member within the drawing ring and connected to it. At least one has a planet member engaging the wheel member, and an annular sun member secured to a shaft. The planet member is connected to the wheel member of the next adjacent capstan to operatively interconnect the adjacent capstans, and permit the planet member to revolve about said sun member and rotate about the central axis.

11 Claims, 10 Drawing Figures

WIRE DRAWING MACHINES

BACKGROUND OF THE INVENTION

The present invention relates to multiple capstan wire drawing machines and in particular to the construction of a drum having at least two capstans.

A wire drawing machine in which at least two capstans of equal diameter, having an outer circumferential drawing ring, are mounted in operative connection to each other as disclosed in U.S. Pat. No. 1,973,596.

In the arrangements disclosed in this patent, the first and the last capstan must both be driven, and the capstans disposed therebetween are coupled by a complex arrangement of ring gears and by bevel gears rotatably mounted herein to the driven capstans. Apart from the comparatively many individual components, this construction is quite a complicated design, resulting in the disadvantage that drawing capstans can neither be added nor omitted, since otherwise the transmission ratio from one to another would no longer be correct.

It is an object of the present invention to provide a drawing drum for multiple wire-drawing machines, which makes possible a more compact and improved method of construction for each of the capstan units and which, by using identical structual units, permits variation in the increase or reduction of the number of capstans (i.e., the number of passes for drawing the wire) and which, in addition, is also suitable for drawing operations wherein the wire must be immersed in a liquid.

SUMMARY OF INVENTION

According to the present invention, a drum for a multiple wire drawing machine is provided comprising an arrangement of at least two adjacently located capstans operatively connected to each other at least one of which is driven by a central drive shaft. Each of the capstans comprises an annular drawing ring and a wheel member located within the drawing ring, and connected thereto for conjoint rotation. At least the one driven capstan has a planet member engaging the associated wheel member, and an annular sun member secured to the shaft. The planet member is provided with means connected to the wheel member of the next adjacent capstan assembly to operatively interconnect the adjacent capstans, and permit said planet member to revolve about the sun member and rotate about the central axis.

Preferably the planet member includes a supporting shaft extending with a connected to the wheel member of the adjacent capstan.

The wheel member, the planet member and the sun member may comprise intermeshing gears or frictionally engaging non-positive transmission means such as a clutch.

Further, a seal is interposed between the capstan assemblies which preferably seats on the wheel member of one of the capstan assemblies and on a sliding surface of the wheel member or drawing ring of the other capstan assembly.

Amongst the objects and advantages of the present invention is achievement of a drawing drum wherein each capstan forms an interchangeable structural unit, of which the drawing ring may be a part of an internally toothed or flanged hollow wheel which is rotatably mounted about a sun wheel and which carries a planet member, which rolls on the sun wheel and which simultaneously, to effect the differential transmission, produces the operative connection to the adjacent structural unit. To facilitate the assembly and dismantling of such capstans, it is advantageous that the hollow wheel or flange member includes a packing element and be provided with a sealing surface which is separate from the latter and which serves as a sliding surface for the packing element of the adjacent capstan.

To make such capstans suitable for use for all loads which arise, ratios of the planetary members are capable of being selected and varied to correspond to the desired strength of the force which is to be transmitted. This can be obtained by a planet member of a stepped construction, one step having an operative connection with the sun member, while the other step has an operative connection with the wheel member of the adjacent capstan. By this means, the effect is produced of obtaining larger or smaller differences in rotational speed between two adjacent units than is possible with simple planet members.

It is also advantageous to reduce expense and noise to use transmission elements (e.g., friction rollers and the like) to serve for the transmission of the force. A machine which does not require much maintenance can be produced by using elements which consist wholly or almost completely of resilient wear-resistant material (e.g., of polyamide or polyurethane).

With a view to a further reduction of maintenance and of saving constructional parts, it is possible to mount the planet member in an overhung or cantilevered arrangement on the supporting shaft. However, in order to provide a more robust machine, it is advantageous for the supporting shaft of the member to be supported at both its ends.

Full details of the present invention are set forth in the following disclosure and are shown in the accompanying drawings.

DESCRIPTION OF THE INVENTION

Figure 1:
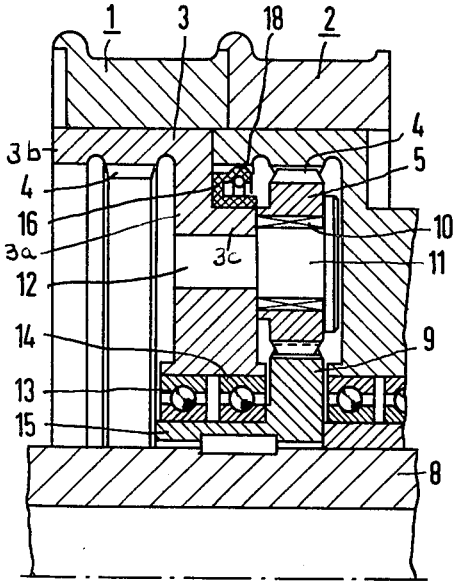
FIG. 1 is a partial elevation of two adjacent drawing capstans in section with a packing ring, of which the packing surface is formed by the internal surface of the annular wheel member and having a collar stud mounting for a simple planet gear.
Figure 2:
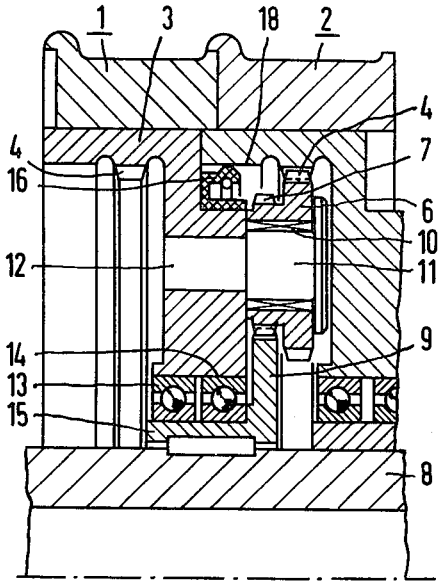
FIG. 2 shows an arrangement of corresponding form and a mounting for a stepped planet gear.

In FIGS. 1 and 2, there is shown in a radial cross section through the central axis, for illustrative purposes, a drum comprising an arrangement of two capstan assemblies mounted axially in adjacent sliding contact and driven in accordance with the present invention. It will be understood that although only a pair are shown, additional capstans of similar construction, in any desired number, can be arranged in series assembly to form a complete multiple capstan drum to draw wire.

Figure 4:
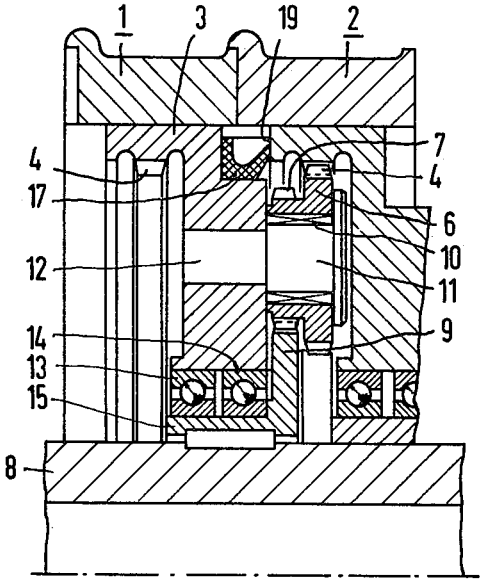
FIG. 4 shows the arrangement of an axially operative sealing ring, the end face of the adjacent wheel member serving as the sealing surface.
Figure 8:
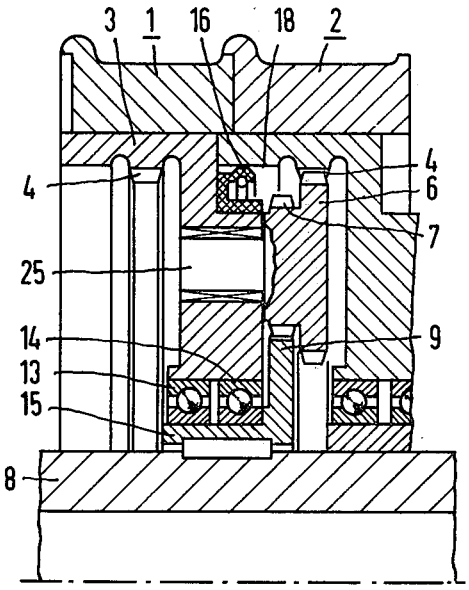
FIG. 8 shows a corresponding construction with a stepped planet gear.

Each assembly comprises an outer drawing ring 1 or 2 of suitable material to draw the wire. The rings are shaped with interlocking flange and axial ends to overlap each other. Located within each of the drawing rings 1 and 2 is an annular wheel gear having a radially extending web 3*a* (i.e. hub) and an axially extending portion 3*b*. The wheel gear 3 may be an integral part of the drawing rings or the two may be fastened or adapted to be keyed by its outer surface to the inner surface of the drawing for conjoint rotation. The inner surface of the axial portion 3*b* is formed with a continuous set of gear teeth 4. In at least one of the capstan assemblies the drawing ring is connected by a differential transmission system of planetary nature to a central supporting shaft 8, in which there is arranged a drive shaft (not shown) driven in conventional manner as for example by means shown in the aforementioned patent, and by connection to be shown to the next adjacent wheel gear. To this end, the inner peripheral surface of the axial portion 3*b* of the wheel 3 is provided with teeth 4 which, in the embodiment of FIG. 1, meshes with a simple spur-type planet gear 5. Instead of the simple planet gear 5, a multi-stage planet gear, as illustrated in FIGS. 2, 4 and 8, may be employed, which in addition to a primary spur gear 6, adapted to mesh with the gear 4, has a secondary coaxial spur gear 7 of smaller diameter. The second gear 7 may be selected, however, with the same diameter or of a larger diameter than that of the primary gear, depending on the transmission ratio desired.

The simple planet gear 5 of FIG. 1 and the secondary planet gear 7 of FIG. 2 engage with a sun gear 9 which is fixed to the central supporting shaft 8. The simple planet gear 5 (of FIG. 1) and the multi-stage planet gears 6, 7 (FIG. 2) are mounted to freely rotate about their central axes by means of a bearing 10 arranged about a shoulder 11 of a removable supporting pin or bolt 12 having a head. The pin 12 is held within a bore in the web 3*a* of the wheel gear 3 so that the planet gear 5 may revolve about the central shaft 8 conjointly with wheel gear 3.

The inner ring of the wheel gear 3 is journalled on a pair of radial bearings 13 and 14 about an axial extension 15 integral with the sun gear 9. It will be seen that the arrangement thus described permits the assembly to be easily and swiftly disassembled by axially withdrawing the wheel gear 3, the planet gear 5 or 6, 7, etc., and permits any or all of the elements to be easily replaced or exchanged.

Figure 3:
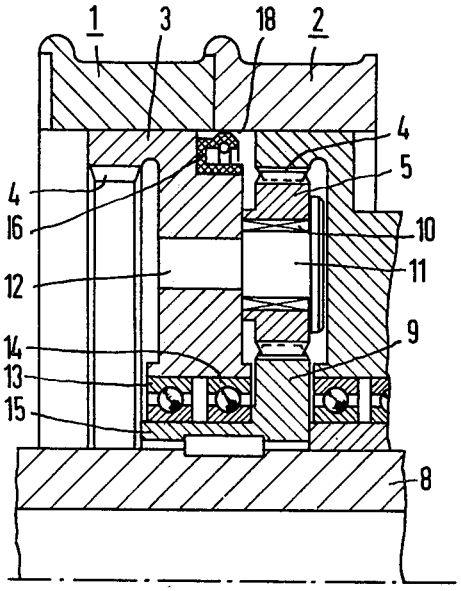
FIG. 3 shows the arrangement of a radially acting sealing ring, of which the sealing surface is formed by a part of the inside of the drawing ring.

The assembly of paired capstans is sealed by either using a radial seal packing 16, as seen in FIGS. 1, 2 and 3, or an axial seal packing 17 illustrated in FIG. 4. The radial packing 16 comprises an annulus adapted on the one hand to seat on an axial surface 3*c* of an annular shoulder extending rearwardly from the web 3*b* of wheel gear 3 and on the other hand to slide on the axially extending surface of the drawing ring 2 or the axially inner surface of the opposite end of the gear portion 4 associated with the adjacent capstan. In either event, the axial slide engaging seal surfaces are indicated by the numeral 18. The axial packing 17 (FIG. 4), is also adapted to seat on the axial shoulder extension 3*c* of the web 3, makes sealing engagement with an opposing radial surface 19 formed on the frontal edge of the gear portion 4 of the adjacent wheel gear 3.

The mounting of the planet gear 5, and/or multi-stage planet gear 6/7, may be selectively varied depending on the load conditions which are to be expected. For example, in FIG. 5, the simple planet gear 5 is provided with axially extending integrally connected stub shafts 20 and 21 each of which is journalled in a bearing 22. The bearing 22 associated with the stub shaft 20 is accommodated in a bore formed in the web 3*b* of the wheel 3, next adjacent to it, while the bearing 22 associated with stub shaft 21 is accommodated in a bore formed in a supporting bridge member 23. In this embodiment, the bearings 13 and 14 associated with the sun gear 19 are separated on either side of the sun gear so that bearing 13 supports the wheel gear 3, as previously described, while the bearing 14 supports the bridge member 23, which is thus rotatable about the central drive shaft. The wheel gear 3 is also modified somewhat at the outer circumference, forming a radially extending flange with axial set back to accommodate the drawing rings 1 and 2. A radial packing 16 is provided.

Figure 5:
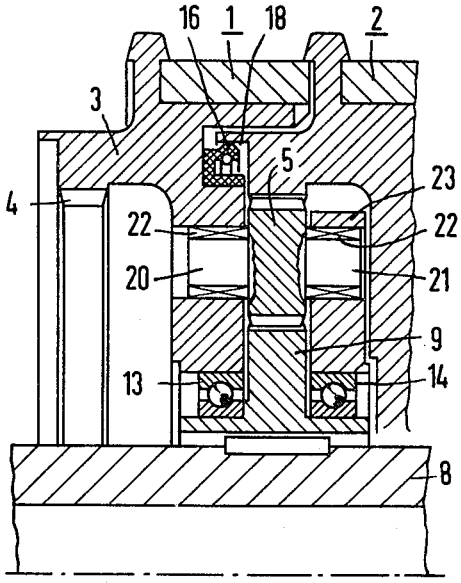
FIG. 5 shows an arrangement in which the planet member is supported on both sides by a stub shaft, serving to accommodate a bearing.
Figure 6:
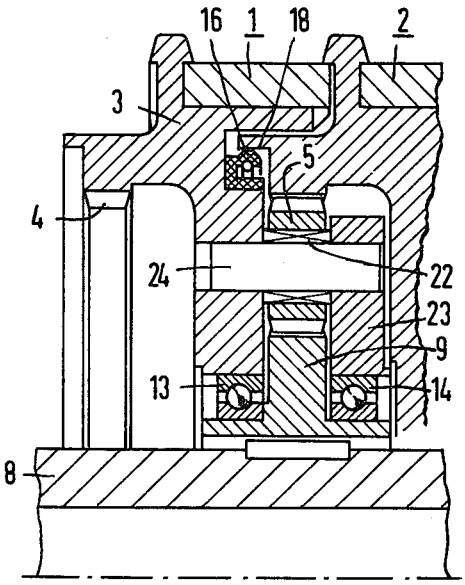
FIG. 6 shows a corresponding arrangement, in which the planet member itself comprises a bearing which is fixed centrally on a through shaft which is fixed at one end in the wheel member and at the other end in a bearing bridge.

The modification shown in FIG. 5 may be further varied as illustrated in FIG. 6. Here the planet gear 5 is formed as an annulus journalled by bearing 22 about a removable supporting shaft 24 fixed at its respective ends in the web of wheel gear 3 associated with drawing ring 1 and the bridge 23 associated with drawing ring 2.

Figure 7:
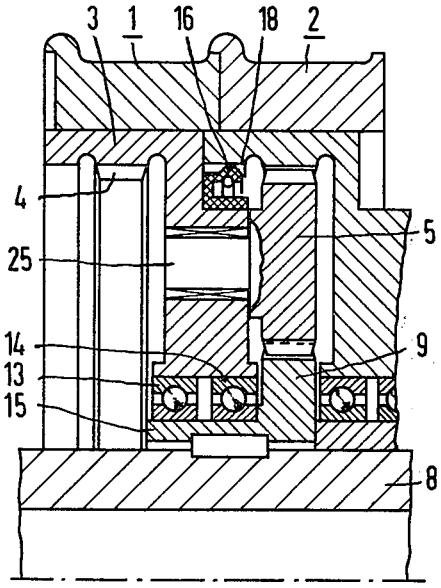
FIG. 7 shows an arrangement in which the planet member and the bearing pin arranged at one end form a structural unit.

In FIG. 7, a variant similar to that shown in FIG. 1 is illustrated. Here, however, the planet gear 5 is integrally formed with a bearing pin 25 preferably in the manner of a one-piece cylindrical headed screw, the head being formed as the planet spur gear and the stem as bearing pin. The bearing pin 25 is journalled within the web of the wheel gear 3. The variant shown in FIG. 8 combines the multi-stage planet gear 6/7 of FIG. 2 with the unitary integral construction of a bearing pin 25 shown in FIG. 7.

Figure 9:
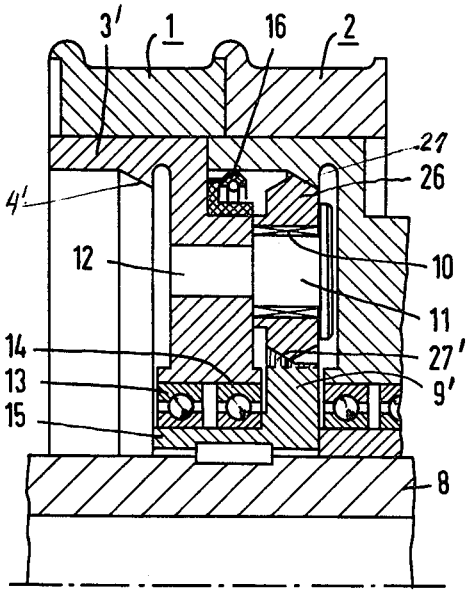
FIG. 9 shows a non-positive transmission element in the form of a double cone planet member.
Figure 10:
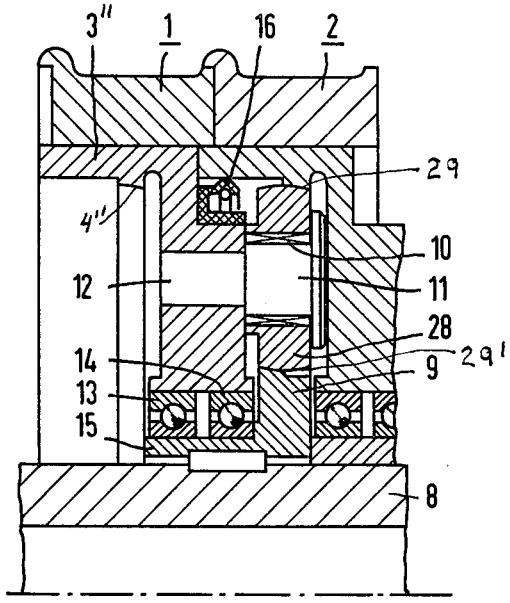
FIG. 10 shows such an element in the form of a spherical planet member.

In FIGS. 9 and 10, a non-positive or friction clutch type transmission rather than the toothed engagement of the planetary gear system is illustrated. In general, the construction shown in FIG. 1 is repeated in FIGS. 9 and 10, except that the wheel 3' and the sun gear 9' are formed with smooth angularly inclined flange surfaces (FIG. 9) or smooth arcuate flange surfaces (FIG. 10) when viewed in cross section, and the planetary gear is replaced with a wheel-like planet member 26 (FIG. 9) or 28 (FIG. 10) having respectively conforming friction surfaces. To insure proper engagement with both the wheel 3 and the sun gear 9, the planet wheel 26 of FIG. 9 is formed with a double cone 27 and 27' while that of the planet wheel 28 of FIG. 10 with a cylindrical surface 29. Advantageously, the planet wheel 28 of FIG. 10 can be formed as a section of a sphere.

In order to guarantee proper force transmission, the engaging surfaces of the members shown in FIGS. 9 and 10 can have their surfaces formed in whole or in part of traction material of relative high coefficients of friction. The material may be adhered by gluing or suitable fastening means to the surface of the wheel or imbedded in strips of foil or the like in the surface. The material may also be sprayed thereon. Suitable high function material may be rubber, synthetics such as polyamides, polyurethane or the like.

Various modifications, changes and embodiments have been shown and others will be obvious to those skilled in this art. Accordingly, the present disclosure is to be taken as illustrative only and not limiting of the scope thereof.

What is claimed is:

1. A drum for a multiple wire drawing machine comprising an arrangement of at least two adjacently located capstan assemblies operatively connected to each other at least one of which is driven by a central drive shaft, each of said capstan assemblies comprising an annular drawing ring and a wheel member located within said drawing ring and connected thereto for conjoint rotation, at least one said driven capstan assembly having a planet member engaging the associated wheel member, and an annular sun member secured to a supporting shaft, means connecting said planet member to the wheel member of the next adjacent capstan assembly to operatively interconnect said adjacent capstans, and permit said planet member to revolve about said sun member and rotate about the central axis, each of said wheel members having a circumferential recess forming an axial shoulder and provided with an annular seal seated thereon slidably engaging a surface of the adjacent capstan assembly.

2. The drum according to claim 1 wherein each of said wheel members comprises a radial hub having an integrally formed circumferential flange at its outer edge, the outer surface of said circumferential flange engaging the inner surface of said drawing ring and the inner surface of said circumferential flange engaging said planet member, and spaced from said shoulder to form an annular gap about said shoulder, said annular seal being located in said gap and slidingly engaging a surface of said circumferential flange of the wheel member of the next adjacent capstan.

3. The drum according to claim 2, and slidingly engaging the frontal edge of said circumferential flange of the wheel member of the next adjacent capstan assembly to form an axial seal.

4. The drum according to claim 2, and engaging the inner surface of the drawing ring of the next adjacent capstan assembly to form a radial seal.

5. The drum according to claim 2, said circumferential flange extending axially over said gap to overlap said shoulder and said seal means slidingly engaging the overlapping inner surface of the flange of the next adjacent capstan assembly.

6. The drum according to claim 2, wherein said planet member comprises a multistage spur gear, one of said stages meshing with an annular gear formed on the engaging surface of the wheel member and another of said stages with an annular gear formed on the sun member.

7. The drum according to claim 1, wherein the engaging surfaces of the circumferential flange, the planet member and the sun member comprise cooperating friction clutch means of high friction material.

8. The drum according to claim 7, wherein the friction material is selected from the group consisting of polyamides and polyurethanes.

9. The drum according to claim 1, wherein said planet member is mounted on an axle supported at one end with the wheel member and at the other end in an annular disk journalled about the supporting shaft, between the sun gear and the next adjacent wheel member.

10. The drum according to claim 9, wherein the planet member is journalled about the axle and fixed to said supporting wheel and annular disk.

11. The drum according to claim 9, wherein the axle of the planet member is journalled at each of its ends in said supporting wheel and annular disk respectively.

* * * * *